US005261798A

United States Patent [19]

Budde

[11] Patent Number: 5,261,798

[45] Date of Patent: Nov. 16, 1993

[54] DOUBLE MEMBRANE PUMP

[75] Inventor: Dirk Budde, Langenfeld, Fed. Rep. of Germany

[73] Assignee: ALMATEC Technische Innovationen GmbH, Duisburg, Fed. Rep. of Germany

[21] Appl. No.: 968,095

[22] Filed: Oct. 29, 1992

[30] Foreign Application Priority Data

Nov. 8, 1991 [DE] Fed. Rep. of Germany ..... 4136805

[51] Int. Cl.[5] ..... F04B 17/00

[52] U.S. Cl. ..... 417/393; 417/395

[58] Field of Search ..... 417/393, 395, 396, 397

[56] References Cited

U.S. PATENT DOCUMENTS

| | | | |
|---|---|---|---|
| 2,711,134 | 6/1955 | Hughes | 417/395 |
| 2,850,981 | 9/1958 | Arp | 417/396 |
| 3,276,389 | 10/1966 | Bower, Jr. | 417/395 |
| 4,674,958 | 6/1987 | Igarashi et al. | 417/393 |
| 4,836,756 | 6/1989 | Fukumoto | 417/394 |
| 4,881,876 | 11/1989 | Laziou | 417/395 X |

OTHER PUBLICATIONS

"Loba-Druckluft-Membranpumpen", DEPA Informationsschrift LP 004, DEPA GmbH, Dusseldorf, Germany, date unknown.

*Primary Examiner*—Richard A. Bertsch
*Assistant Examiner*—Alfred Basichas
*Attorney, Agent, or Firm*—Anderson Kill Olick & Oshinsky

[57] ABSTRACT

A double membrane pump comprising a central housing (1), two coaxial product chambers (6) in the central housing, suction and pressure valves for each product chamber, two membranes (7) sealing off the product chambers externally from coaxial pressure fluid chambers (8), piston rods (13) guided in external seals, a U-shaped external crosspiece (17) connecting the piston rods of the membranes and a control block for reciprocally pressurising the pressure fluid chambers with pumping medium and comprising a slide valve (20) actuated by the movement of the membranes. The pump provides a very short path for the pumping flow, with only two changes in direction, and only static seals. It can be made wholly of plastics materials and is particularly suitable for high-purity products in the semiconductor industry, in biotechnology and in the pharmaceutical, cosmetic and foodstuffs industries.

14 Claims, 4 Drawing Sheets

DOUBLE MEMBRANE PUMP

TECHNICAL FIELD OF THE INVENTION

The invention relates to a double membrane pump having two membranes, a slide valve displaceable in dependence on the movement of the membranes and an actuating member dependent on the movement of the membranes.

BACKGROUND OF THE INVENTION AND PRIOR ART

A double membrane pump of this kind is described in German Offenlegungsschrift 33 10 131. In this double membrane pump the two membranes are connected together by a coupling rod and the pressure fluid chambers are located in the region between the membranes while the product chambers are located outside. The actuating member is arranged parallel to the coupling rod and consists of an axially displaceable rod projecting from the slide valve housing and arranged coaxially in the slide valve. This rod acts in both directions through a compression spring on the slide valve which is held in its end positions by spring loaded ball catches until the force of the springs arranged coaxially on the actuating rod exceeds the retaining force. Driven by the force of the springs, the slide then speeds to the opposite control position and brings about reversal of the movement of the membrane. In this way the valve slide is caused to reciprocate between two stable end positions.

Since the known double membrane pump only has movable suction and pressure valves in the region of the product chambers, and elsewhere only static seals, it is well suited for pumping high purity products such as acids, caustic alkalis and solvents in the semiconductor industry because there is little risk of abraded particles. However the flow path constitutes a disadvantage, since the product being pumped has to pass around the control block with the membranes, the coupling rod and the slide valve, which gives rise to a large surface in contact with the product, and four changes in the direction of flow are necessary between intake and outlet. Moreover a large number of seals are needed. Finally in this arrangement there is also the risk of dimensional changes with variations in temperature. Should this lead to difficulties in the control of the pumping fluid, the whole pump, including the parts in contact with the product, has to be dismantled.

Furthermore, in the known double membrane pump the membrane is sealed by a simple annular bead that has to ensure radial retention as well as for sealing. This is unsatisfactory, since in this region the membrane is highly stressed, and when a flowable membrane material such as PTFE is used the bead does not guarantee perfect retention and sealing in the long term.

OBJECT OF THE INVENTION

It is therefore an object of the invention to provide a double membrane pump for conveying high purity products that ensures the least possible amount of abrasion, as well as having as small a surface as possible in contact with the product and no sliding seals in the region of the pumping stream, and preferably also giving improved retention and sealing of the membrane.

SUMMARY OF THE INVENTION

To achieve this object, the invention contemplates providing a double membrane pump having a central housing, two product chambers, two membranes sealing off the product chambers from coaxial pressure fluid chambers, piston rods sealingly guided outwards and a preferably U-shaped external connection between the piston rods of the membranes, preferably an external crosspiece, and a control block for controlled reciprocal pressurising of the pressure fluid chambers with pumping medium, that may be provided with a slide valve actuated by the movement of the membranes.

In the double membrane pump of the invention the product chambers are located in the central housing, are sealed from the outside by the membranes, and the membranes are reciprocally acted on through pressure fluid chambers sealed from the product chambers. The two membranes are mechanically connected together by the U-shaped crosspiece, so that there is no longer any connection between the membranes that passes through the central housing with the product chambers. The product chambers directly adjoin one another and are only separated by a wall of the central housing, which can withstand the pressure difference between the product chambers and has room to accommodate at least the suction and pressure conduits. In this way the surfaces in contact with the product are made as small as possible; there are only two changes in the direction of flow between intake and outlet, the number of seals in the region contacted by the product is limited to the seals of the suction and pressure valves and the membrane seal, and the control parts for the pumping medium, particularly compressed air, can be exchanged without dismantling parts exposed to the product.

To reduce the pulsation of the delivery flow resulting from the pump design, a pulsation dampener acted on by the pressure can be connected on the pressure side of the pressure valve, which can be fitted with a membrane of the same kind as that of the double membrane pump. As a result there are only two parts of the housing exposed to the product, namely the central housing and the housing of the pulsation dampener, which possess no sharp corners or dead spaces in which particles can be deposited.

All parts exposed to the product, such as the central housing, valves, membranes and pulsation dampener housing, may consist of solid PTFE-TFM, while all parts not exposed to the product, such as housing covers, control block, pulsation dampener housing cover and outer covers, including the nuts on the tension bolts, may consist of solid PVDF. Consequently vapours containing acid or solvent cannot harm the external parts; the whole of the double membrane pump is proof against corrosion by all media that are used in the semiconductor industry.

The internal parts of the double membrane pump that are not exposed to product may consist of PETP, POM, PTFE-PPS, while highly stressed components such as tension bolts and the U-shaped external crosspiece may consist of EP resin 60 GF.

To provide a perfect seal between the central housing and the housing cover and hold it exactly in position, which is particularly necessary when membranes of solid PTFE-PFM without metallic cores or supporting plates are used, the membrane can have at its outer circumference two oppositely directed, radially offset annular beads, one of which is in the form of a grooved bead having a tension ring inserted in the groove. In this way the surface exposed to the product can be made flat, even and uniform, with no internal crevices in which particles could be deposited. In addition there is only one sealing surface facing the central housing.

Advantageously the grooved bead has a greater radius than the annular bead and the groove is axially open in the direction of the annular bead. A tension ring, preferably consisting of an elastomer of high Shore hardness, is inserted in the groove, and the annular beads can advantageously exhibit a rectangular cross section. The tension ring can exhibit an axial height corresponding to the depth of the groove in the grooved bead and the height of the annular bead, so that the annular bead and the tension ring can be arranged side by side in the same annular groove in the housing.

The membrane is constantly pressed against the central housing by the tension ring. Two of the three surfaces act radially; they are not dependent on the tension in the tension bolts, and one acts axially for the greatest possible security. In the event that the housing cover is dismounted, the membranes remain firmly and sealingly seated in the central housing, and thus protect the product being pumped.

In this way the objects of fixing in position and sealing are separated, and the members performing these functions can each have the optimum shape. The sealing is effected against the housing by the tension ring inserted in the groove and the two large concentric annular surfaces of the membranes. Pressure is constantly exerted on these annular surfaces by the tension ring located between them, independently of the axial pretensioning of the pump. Even an annular gap up to a millimeter wide between the parts of the housing does not lead to leakage or to the membrane tearing out. Servicing and monitoring of the pretensioning is eliminated.

BRIEF DESCRIPTION OF THE DRAWINGS

The invention will now be described in more detail with reference to an exemplary embodiment shown in the drawings, in which.

DETAILED DESCRIPTION OF PREFERRED EMBODIMENTS OF THE INVENTION

Figure 1:
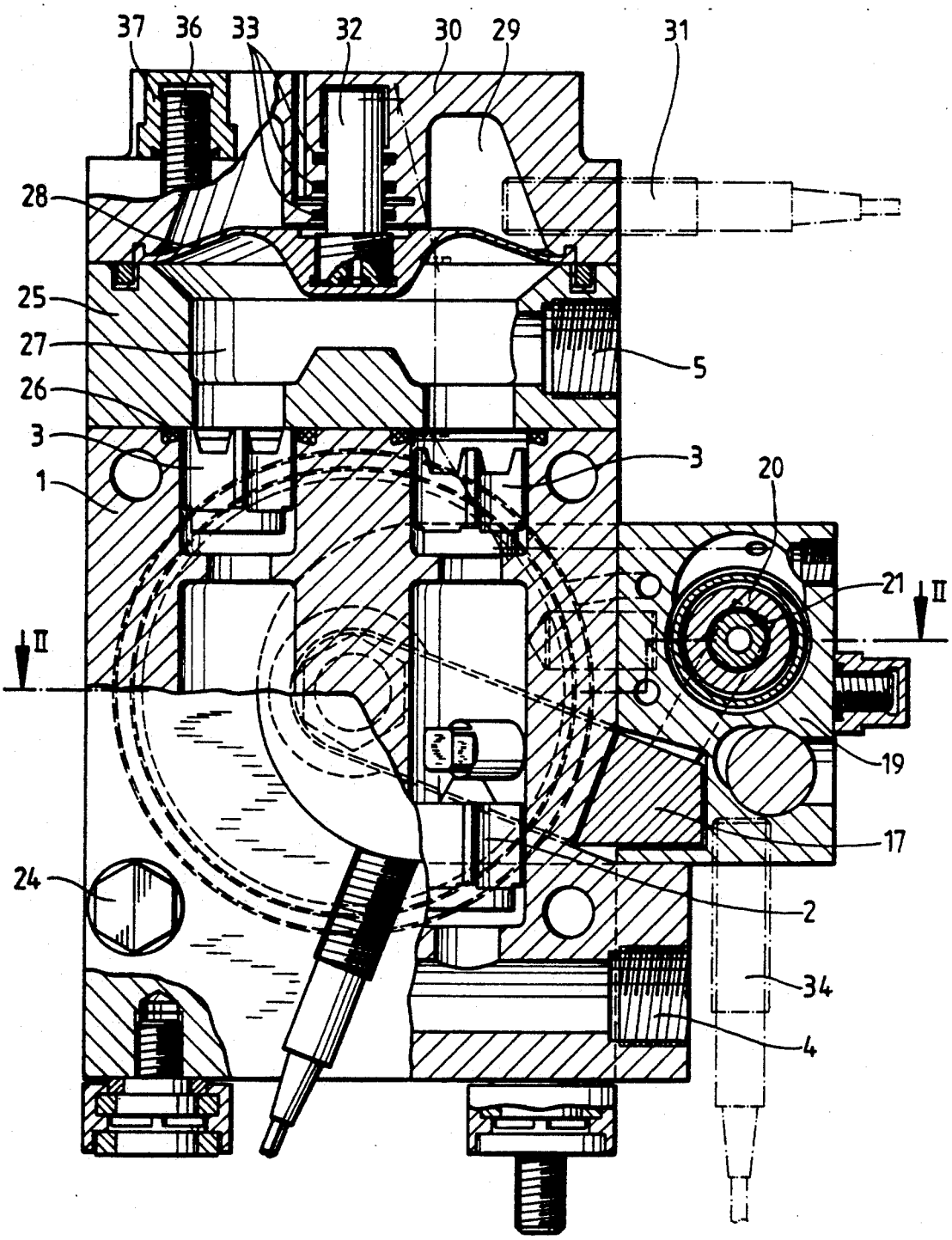
FIG. 1 is a sectional view of a double membrane pump.
Figure 2:
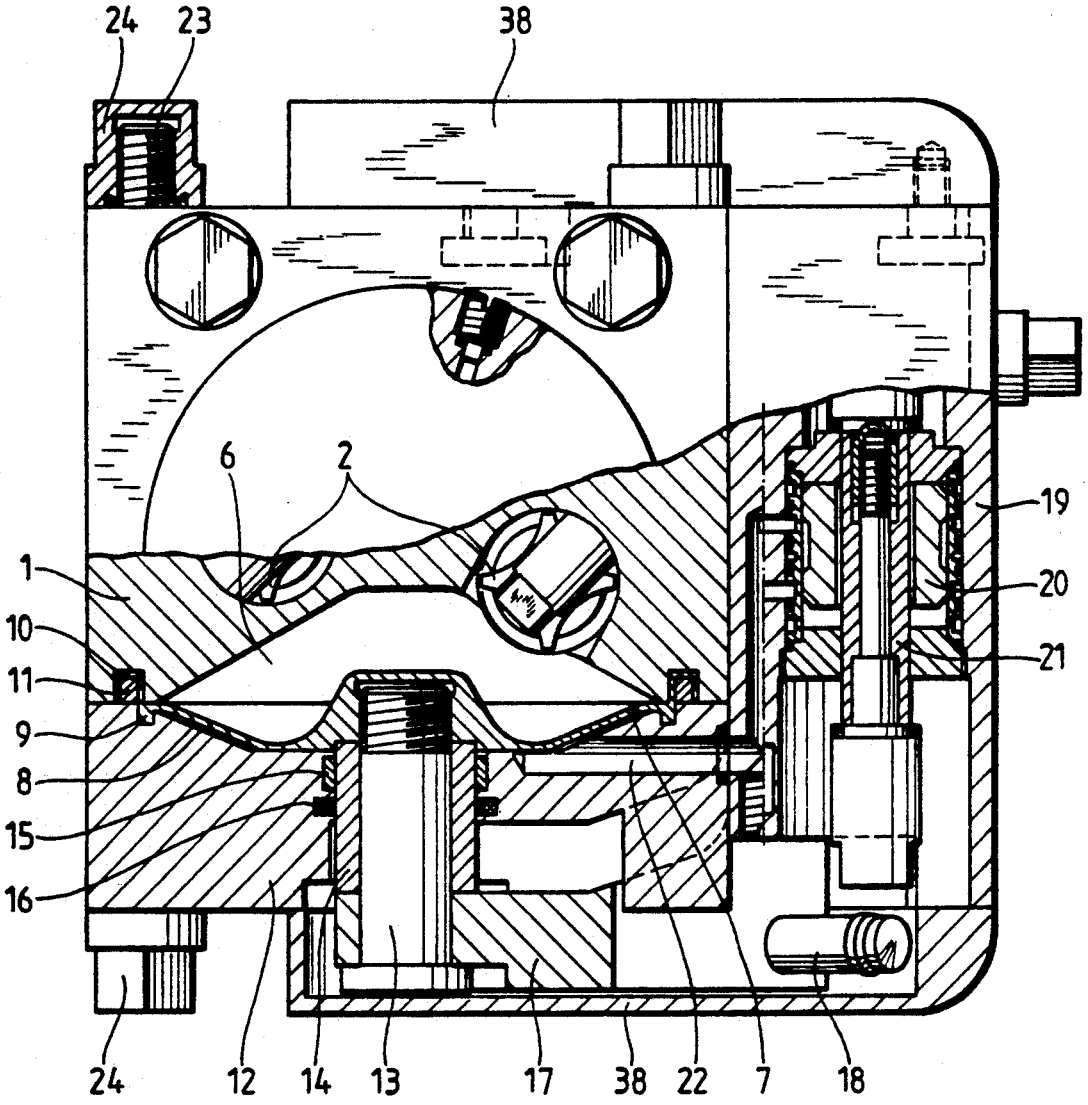
FIG. 2 is a partial sectional view along the line II—II in FIG. 1.
Figure 2A:
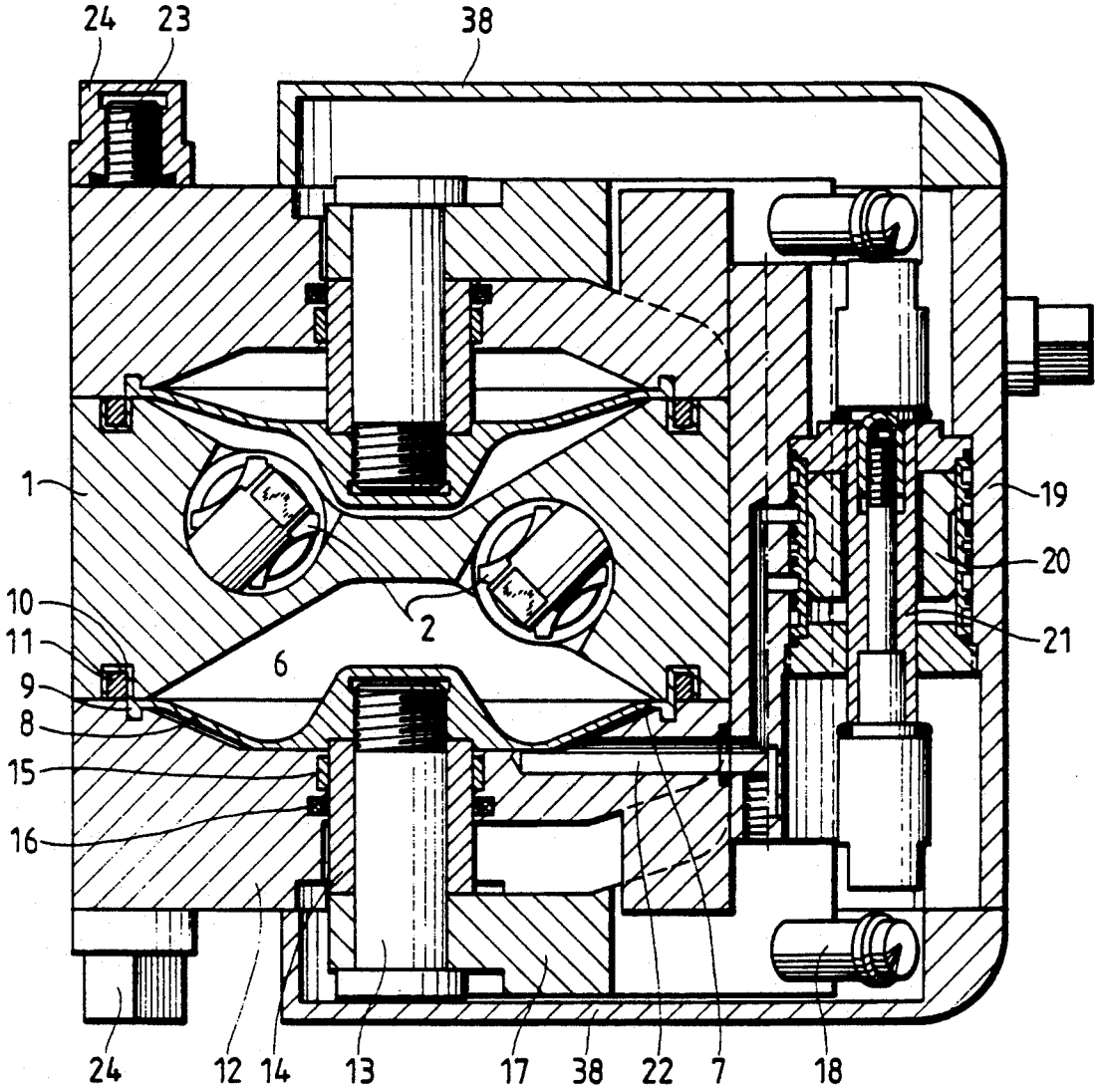
FIG. 2A is a full sectional view along line II—II in FIG. 1
Figure 3:
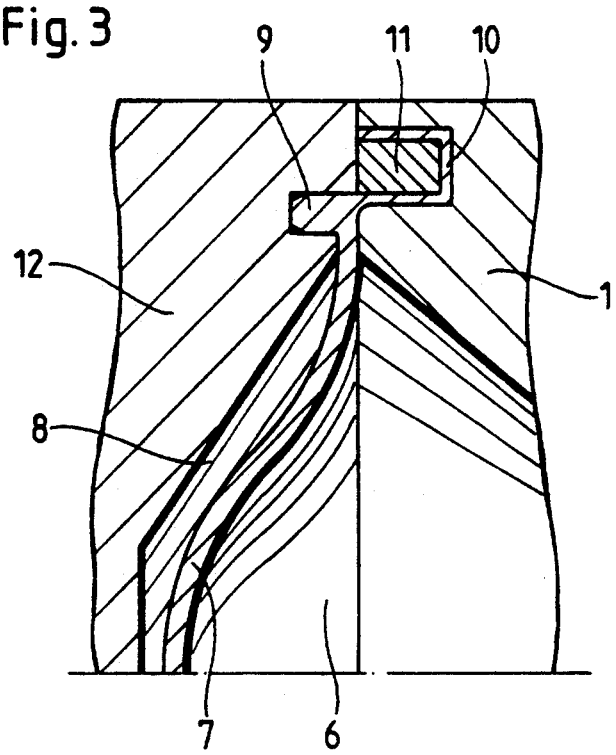
FIG. 3 is a view on a larger scale of a membrane with annular beads.

The double membrane pump has a central housing in which are arranged suction valves 2, pressure valves 3 and a suction connection 4. In addition coaxial product chambers 6 are arranged in the central housing 1 and are connected to the suction valves 2 and the pressure valves 3. Each product chamber 6 is closed off by a membrane 7 which, together with the housing cover 12 bolted to the central housing 1, forms a pressure fluid chamber 8.

At the outer circumference of the membrane are arranged annular beads 9, 10 that are offset radially from one another. The annular bead 9 is located in a corresponding annular groove of the cover 12 of the housing, while the annular bead 10 is located in a corresponding annular groove in the central housing 1 and exhibits a circumferential open groove, directed axially in the same direction as the annular bead 9, in which a tension ring 11 of an elastomer of high Shore hardness is inserted. The housing covers 12 are braced against the central housing 1 by tension bolts 23 and nuts 24. A piston rod 13 is screwed into the central region in the middle of the membrane 7 and guided by a bush 14 in a guideway 15 in the housing cover 12 and sealed by a seal 16. The coaxial piston rods 13 of the adjacent coaxial membranes 7 are connected together by a form-fitting U-shaped external crosspiece 17. In the position shown the membrane 7 lies up against the housing cover 12 so that the piston rod 13 and the crosspiece 17 are in one extreme position. Through the crosspiece 17 the other membrane, not shown, is likewise moved in the same direction and practically fills the product chamber 6.

If the pressure fluid chamber 8 is pressurised with compressed air through the compressed air conduit 22, the product present in the product chamber 6 is displaced and delivered, while the second product chamber sucks in as it becomes larger.

The oscillating pumping movement of the membranes 7 is reciprocally controlled by means of a slide valve 20 arranged in a control block 19. This slide valve 20 is controlled by the movement of the membranes 7 means of an actuating rod 21 that is connected to the external crosspiece 17 through an actuating tappet 18. The control block 19 with the slide valve 20 can be in the form described in German patent application P 41 06 180.2-15.

The mode of operation of the double membrane pump is thus the same as that of the known membrane pumps mentioned in the introduction, and therefore need not be described here in more detail.

A pulsation dampener housing 25 is bolted on to the central housing 1 to one side and is sealed off from the pressure valves 3 by means of seals 26. In the pulsation dampener housing 25 there is a pressure chamber 27 that is closed off by a membrane 28. This membrane 28 has the same form as the membrane 7 and is restrained and sealed between the pulsation dampener housing 25 and a pulsation dampener housing cover 30 in the same way by annular beads 9, 10.

A compressed air connection 31 leads to the pressure fluid chamber 29.

A piston rod 32 that is guided in the pulsation dampener housing cover 30 via seals 33 serves to guide the membrane 28 when it is caused to move by the compressed air supplied via the connection 31 in order to compensate for fluctuations in the delivery flow. The pulsation dampener housing cover 30 and the pulsation dampener housing 25 are connected to the central housing 1 by tension bolts 36 by means of sealed cap nuts 37.

Outer covers 38 are fitted over the U-shaped crosspiece 17 and compressed air is supplied to the control block 19 as pumping medium by way of a compressed air connection 34.

The double membrane pump of the invention can be of completely metal-free construction, so that the formation of metal ions is reliably avoided and consequent risk of harm to microcomponents for the electrical industry is thereby excluded. It is also suitable for high-purity products for use in biotechnology and in the pharmaceutical, cosmetic and foodstuffs industries.

The components exposed to the product, such as the central housing 1, the valves 2, 3, the membranes 7, 28 and the pulsation dampener housing 25 consist of solid PTFE-TFM, while all external parts not exposed to the product, such as the housing cover 12, control block 19, pulsation dampener housing cover 30 and outer covers 38 are made of solid PVDF. The internal parts not exposed to the product consist of PETP, POM or PTFE-PPS, while all highly-stressed components such as tension bolts 23, 26, piston rods 13, 32 and the external crosspiece 17 consist of EP resin GF.

The membranes 7, 28 of the invention can be used in any double membrane pump with correspondingly shaped grooves to receive the annular beads.

Figure 4:
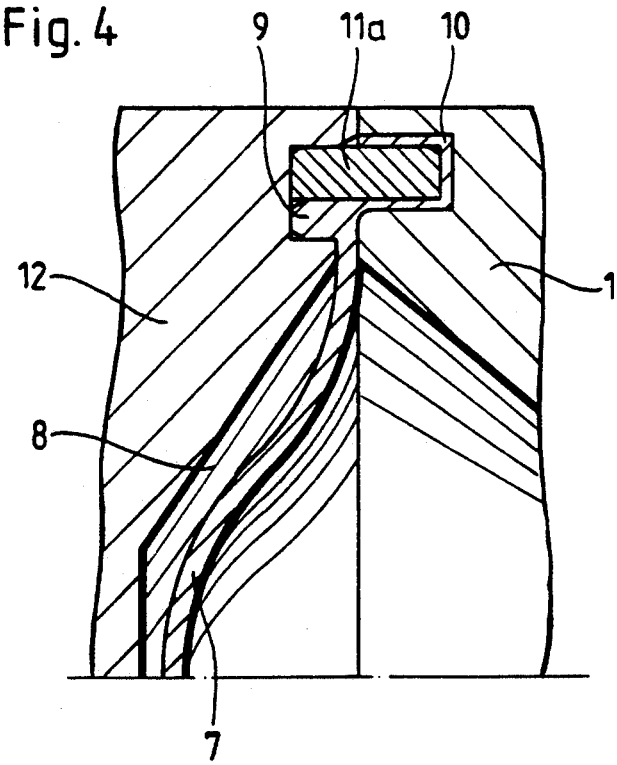
FIG. 4 shows another embodiment of a membrane with annular beads.

In the membrane 7 shown in FIG. 4 only the tension ring 11*a* is different. Its axial height is equal to the sum of the depth of the groove in the grooved bead 10 and the height of the annular bead 9. The groove in the housing 12 accordingly receives the annular bead 9 and the tension ring 11*a* side by side, resulting in a purely radial seal both on the product chamber side and on the pressure fluid side.

What is claimed is:

1. A double membrane pump having a central housing, two product chambers connected to suction and pressure valves, two membranes sealing off said product chambers from pressure fluid chambers, piston rods sealingly, guided to the outside, an external connection between said piston rods, and extending around said central housing, and a control block for controlled reciprocal pressurisation, of said pressure fluid chambers with pumping medium.

2. A double membrane pump according to claim 1, wherein said product chambers are located in said central housing.

3. A double membrane pump according to claim 2, wherein a pulsation dampener acted on by the pressure is connected on the pressure side of said pressure valves.

4. A double membrane pump according to claim 1, wherein all parts exposed to the product consist of solid PTFE-TFM.

5. A double membrane pump according to claim 1, wherein all external parts not exposed to the product consist of solid PVDF.

6. A double membrane pump according to claim 1, wherein all internal parts not exposed to the product consist of material selected from PETP, POM and PTFE-PPS and all highly-stressed structural parts consist of EP resin GF.

7. A double membrane pump according to claim 1, wherein said membranes have on their outer circumference two oppositely directed, radially offset annular beads, one of said beads being formed with a groove and having a tension ring inserted in said groove.

8. A double membrane pump according to claim 7, wherein said annular beads are arranged with different radial spacings.

9. A double membrane pump according to claim 8, wherein said grooved bead has a greater radius than said other bead and its groove is axially open in the direction of said other bead.

10. A double membrane pump according to claim 7, wherein said annular beads are rectangular in cross-section.

11. A double membrane pump according to claim 7, wherein said tension ring consists of an elastomer with high Shore hardness.

12. A double membrane pump according to claim 7, wherein said tension ring has an axial height corresponding to the depth of the groove in said grooved bead and the height of said other bead.

13. A double membrane pump according to claim 12, wherein said other bead and said tension ring are arranged side by side in the same annular groove in said housing.

14. A double membrane pump according to claim 3, wherein said pulsation dampener comprises a membrane having on its outer circumference two oppositely directed, radially offset annular beads, one of said beads being formed with a groove having a tension ring inserted in it.

* * * * *